US005179764A

United States Patent [19]

Iwade et al.

[11] Patent Number: 5,179,764

[45] Date of Patent: Jan. 19, 1993

[54] CLEANING BELTS FOR THE DRAFTING MECHANISM OF A SPINNING MACHINE

[75] Inventors: Takashi Iwade, Kyoto; Kosei Nagata, Moriyama, both of Japan

[73] Assignee: Toray Engineering Co., Ltd., Osaka, Japan

[21] Appl. No.: 735,806

[22] Filed: Jul. 25, 1991

[30] Foreign Application Priority Data

Jun. 3, 1991 [JP] Japan ..... 3-159615

[51] Int. Cl.[5] ..... D01H 5/64

[52] U.S. Cl. ..... 19/245; 19/265; 57/300

[58] Field of Search ..... 19/236, 244, 245, 262, 19/263, 264, 265, 257; 57/300, 306, 315

[56] References Cited

U.S. PATENT DOCUMENTS

| | | | |
|---|---|---|---|
| 2,804,656 | 9/1957 | Purdy | 19/265 X |
| 2,951,268 | 9/1960 | West | 19/265 X |
| 3,086,255 | 4/1963 | Cordis | 19/265 |
| 3,838,476 | 10/1975 | Gort | 19/265 M |
| 4,317,261 | 3/1982 | Adamson | 19/265 |
| 4,370,781 | 2/1983 | Murao | 19/245 |
| 4,706,339 | 11/1987 | Eder | 19/265 |
| 4,922,705 | 5/1990 | Sakai et al. | 19/245 X |
| 5,088,157 | 2/1992 | Yasuda et al. | 19/263 |

FOREIGN PATENT DOCUMENTS

| | | | |
|---|---|---|---|
| 0454422 | 11/1945 | Canada | 19/262 |
| 1151205 | 7/1963 | Fed. Rep. of Germany | 19/265 |
| 1510216 | 8/1969 | Fed. Rep. of Germany | 19/265 |
| 2317777 | 10/1974 | Fed. Rep. of Germany | 19/265 |
| 61-6169 | 7/1985 | Japan . | |
| 64-26727 | 1/1989 | Japan | 19/262 |
| 0672235 | 7/1979 | U.S.S.R. | 19/262 |

*Primary Examiner*—Werner H. Schroeder
*Assistant Examiner*—Ismael Izaguirre
*Attorney, Agent, or Firm*—Burns, Doane, Swecker & Mathis

[57] ABSTRACT

A cleaner for a spinning machine which includes a plurality of drafting mechanisms arranged along an axis of the spinning machine. The cleaner includes a cleaning belt, arranged in each one of the drafting mechanisms to contact at least one drafting roller in the one drafting mechanism, for cleaning fiber dust and lint from at least one drafting roller in the one drafting mechanism; a transporting belt, arranged to contact each of the cleaning belts, for transporting the fiber dust and lint from each of the cleaning belts along the axis of the spinning machine; a scratch-off roller, which contacts the transporting belt and rotates at an angle relative to a running direction of the transporting belt, for removing the fiber dust and lint from the transporting roller; a mechanism for wiping fiber dust and lint from the scratch-off roller; and a mechanism for suctioning the fiber dust and lint which is wiped from the scratch-off roller by the wiping mechanism.

17 Claims, 8 Drawing Sheets

CLEANING BELTS FOR THE DRAFTING MECHANISM OF A SPINNING MACHINE

BACKGROUND OF THE INVENTION

1. Field of the Invention

The present invention relates to a cleaner for a drafting mechanism of a spinning machine having a plurality of drafting mechanisms arranged at predetermined intervals in the longitudinal direction of a machine frame.

2. Description of the Related Art

Generally, in the drafting mechanism for drafting fiber bundles by a predetermined magnification, fiber dust and lint adheres to the peripheries of rollers or apron belts, and unless the fiber links are removed, the fiber dust and lint adheres to the fiber bundles, to consequently form a slub. Therefore, there have been proposed a variety of cleaners for removing the fiber dust and lint adhering to the top roller, the apron belt, or the like of the drafting mechanism. For example, Japanese Examined Patent Publication (Kokoku) No. 61-6169 discloses a cleaner where a clearer apron in contact with the top roller of the drafting mechanism and a comb for scratching off the fiber dust and lint adhering to the apron is arranged inside a roller cover to which a suction duct is connected. The cleaner is shifted at the upper portion of the drafting mechanism in the longitudinal direction of a machine frame, whereby the clearer apron is successively brought into contact with the top roller of each drafting mechanism to cause the fiber dust and lint resting on the top roller to adhere to the clearer apron, and then the fiber dust and lint adhering to the clearer apron is scratched off by the comb, discharged from the suction duct, and finally, accumulated in a dust box and the like.

In such a cleaner, since the roller cover is allowed to run at the upper part of the drafting mechanism, when the top arm of the drafting mechanism is lifted up during an ending or other operation, to make it non-operative, the top arm protrudes into the running passage of the roller cover. Accordingly, a problem arises in that the roller is not allowed to run further, and thus the drafting mechanisms following the concerned drafting mechanism can not be cleaned. Another problem arises in that the clearer apron has different frictional resistance to that of the top roller, depending on the running or stopped condition thereof, since the clearer apron acts intermittently to clean the top roller, and in particular, when the apron belt is attached to the top roller, a slip between the bottom roller and the apron belt occurs to produce a yarn unevenness.

Further, Japanese Unexamined Patent Publication (Kokai) No. 64-26728 discloses a cleaner wherein clearer rollers are raised into contact with the top roller, and the apron belt and the like are arranged on each drafting mechanism so as to be capable of freely rotating and stopping, and a raised endless belt is rotatably mounted on the running member. In this collecting apparatus, the raised endless belt is rotatably mounted on the running member, which is shifted at the upper position of the drafting mechanism in the longitudinal direction of the machine frame, to cause the endless belt to come into rotational contact with the clearer roller disposed on each drafting mechanism, whereby the fiber dust and lint on the clearer roller is scratched off by the endless belt, and then by a scraper, and discharged through the suction nozzle to accumulate in the dust box or the like.

The above-mentioned cleaner has also a drawback in that, since the run of the collecting mechanism is restricted at the upper part of the drafting mechanism, the collecting mechanism is not allowed to further run and the fiber dust and lint on the clearer rollers following the concerned mechanism is not collected when the top arm of the drafting mechanism is lifted up during the ending or other operation to make it non-operative, and providing such a condition lasts for a long time, the top roller of the drafting mechanism is not cleaned.

The first problem to be overcome is that, when the top arm of the drafting mechanism is made non-operative, the roller cover used for a sucking removal of the fiber dust and lint from the top roller and the like of the drafting mechanism, or the collecting mechanism for scratching off the fiber dust and lint adhering to the clearer roller, is not allowed to run.

The second problem to be solved is that the clearer apron has a different resistance to that of the top roller, depending on whether it is running or stopped, and in particular, when the apron belt is mounted on the top roller, a slip arises between the bottom roller and the apron belt, to generate yarn unevenness.

SUMMARY OF THE INVENTION

To overcome the above-mentioned first and the second problems, the cleaner according to the present invention is provided with a transporting belt in contact with a cleaning belt and able to scratch off the fiber dust and lint adhering to the belt and transport it in the longitudinal direction of a machine frame.

Concretely, there is provided a cleaner for a drafting mechanism of a spinning machine including a plurality of drafting mechanisms having a cleaning belt in contact with a drafting roller and arranged at predetermined intervals in the longitudinal direction of the machine frame, the cleaner comprising a transporting belt in contact with the cleaning belt, for scratching off the fiber dust and lint adhering to the belt, for a transportation thereof in the longitudinal direction of the machine frame.

DESCRIPTION OF THE PREFERRED EMBODIMENTS

Embodiments of a cleaner for a drafting mechanism of a spinning machine according to the present invention will be hereinafter described with reference to the accompanying drawings.

Figure 1:
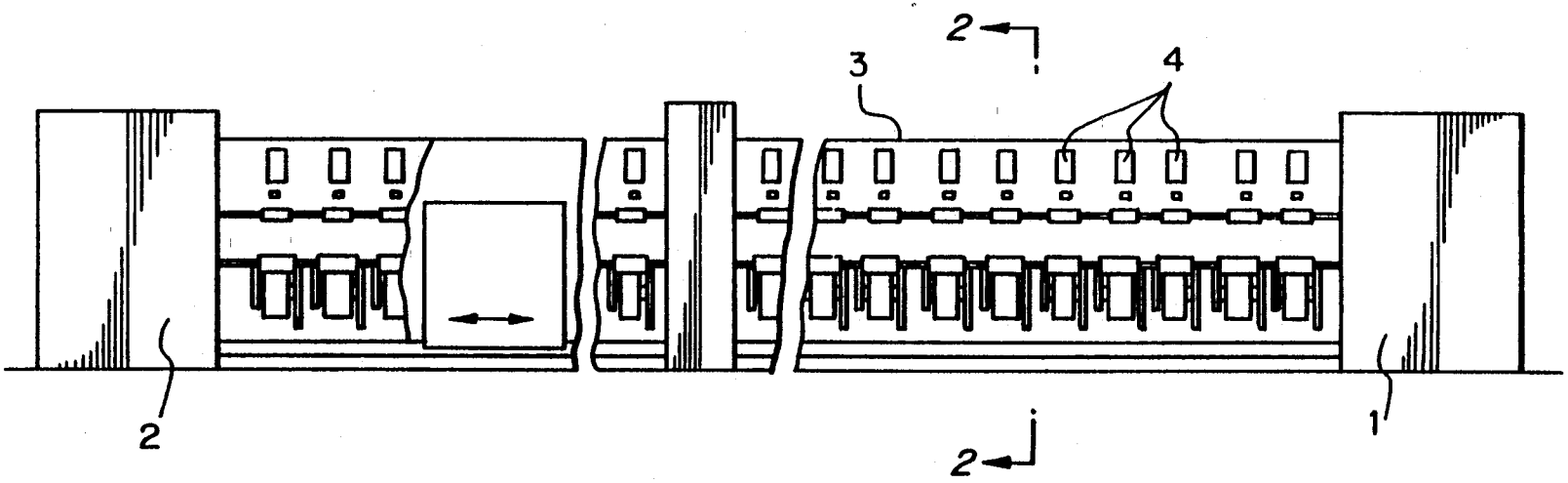
FIG. 1 is a schematic front view showing an embodiment of the spinning machine of the present invention.
Figure 2:
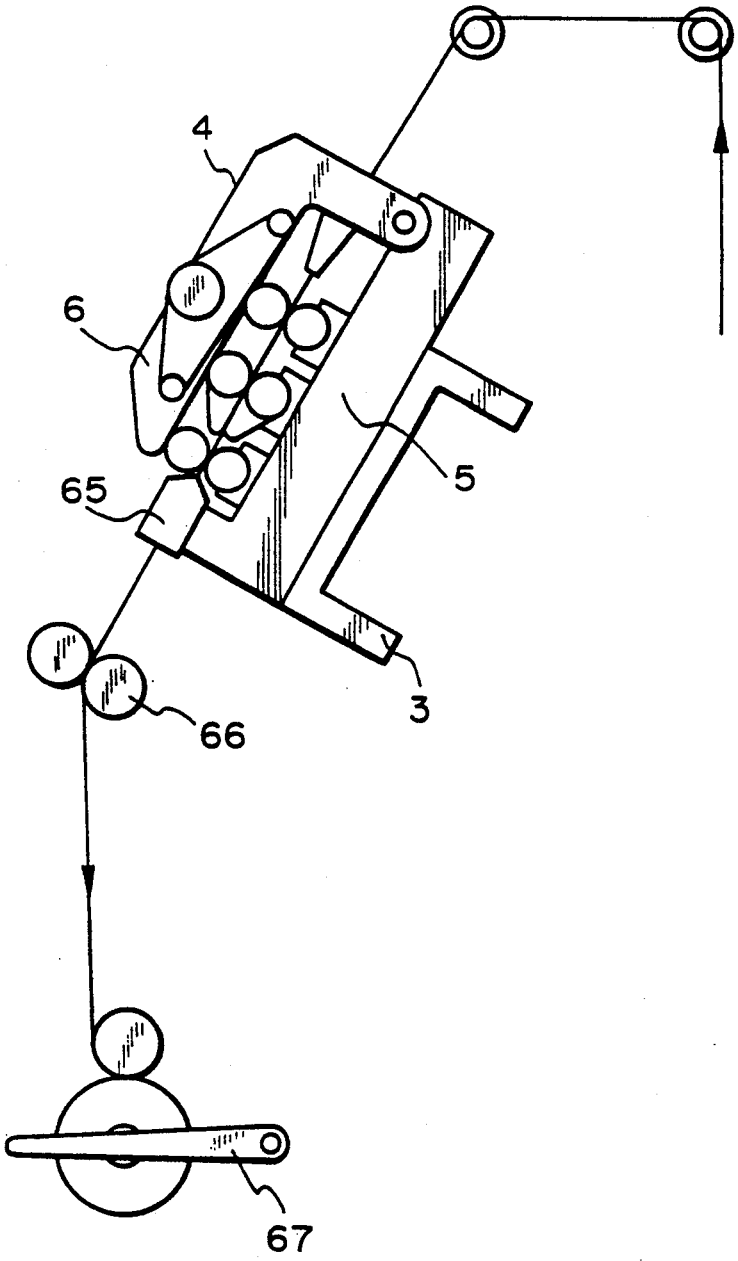
FIG. 2 is a sectional view taken along section line 2—2 viewed from the arrowhead.
Figure 3:
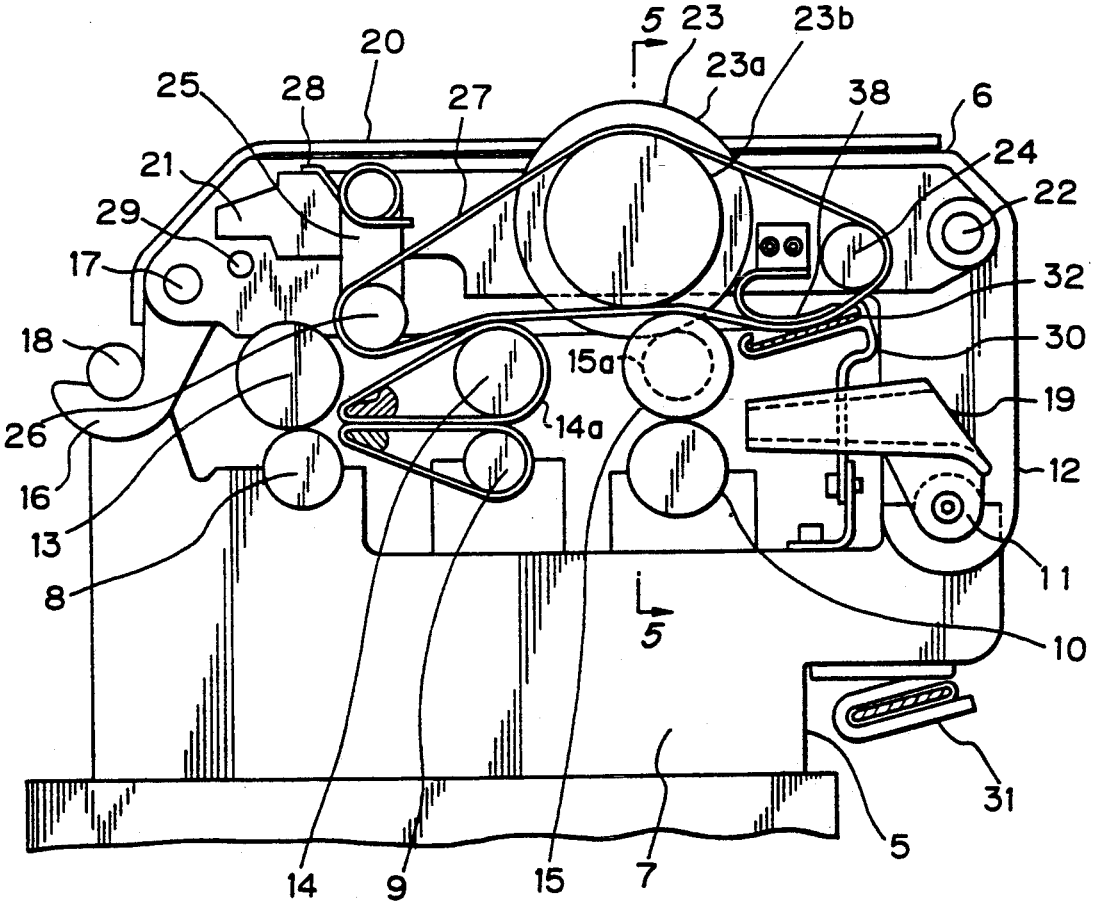
FIG. 3 is a schematic enlarged view showing the detail of the drafting mechanism in FIG. 1.
Figure 4:
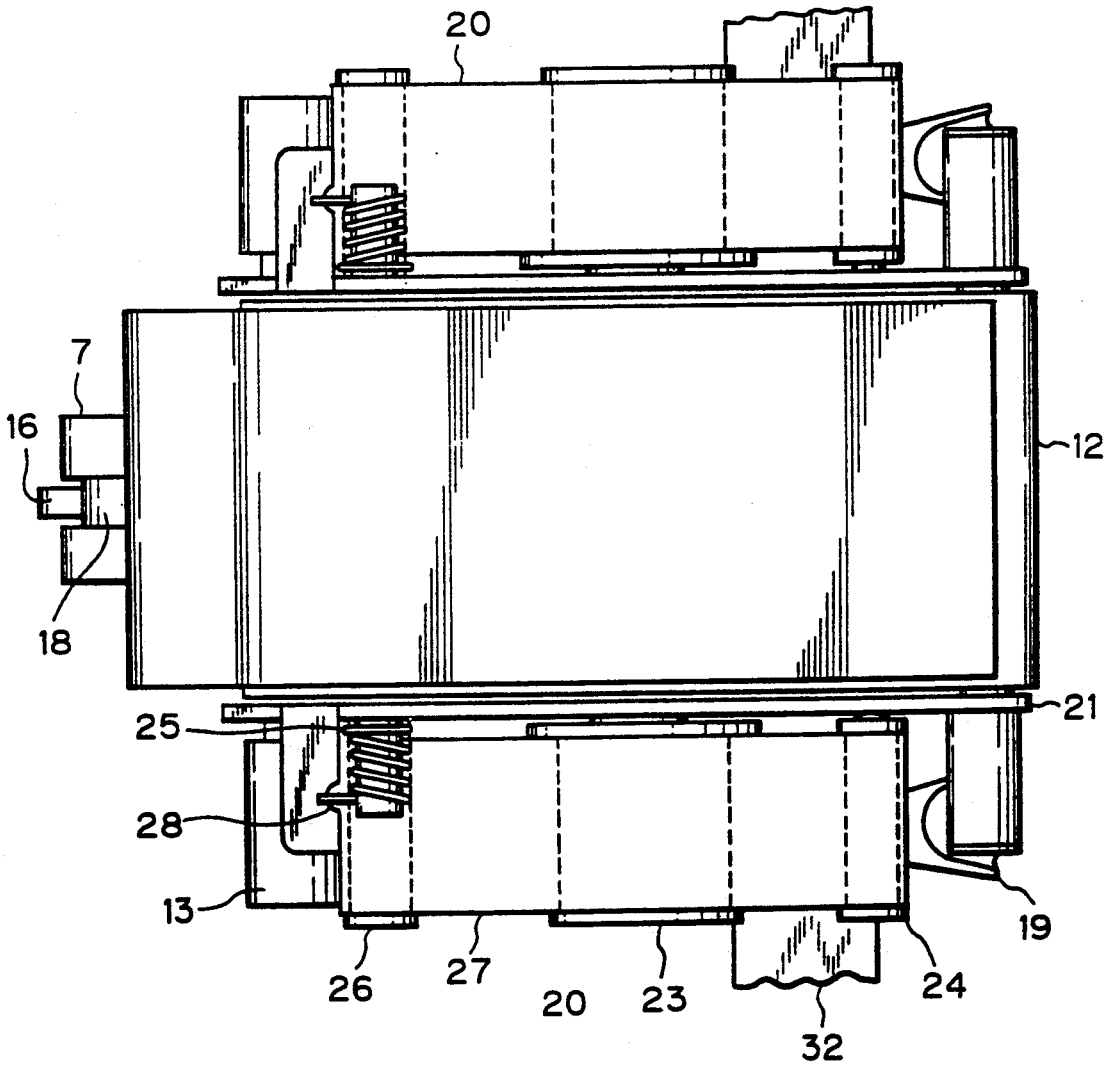
FIG. 4 is a plan view of FIG. 3.
Figure 5:
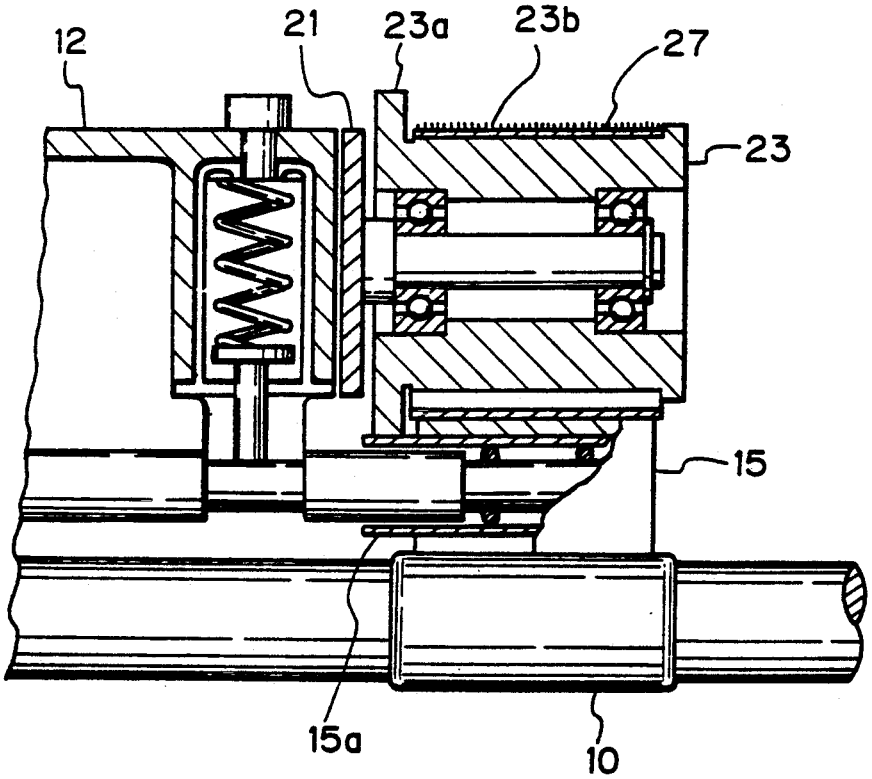
FIG. 5 is a sectional view taken along section line 5—5 viewed from the arrowhead.
Figure 6:
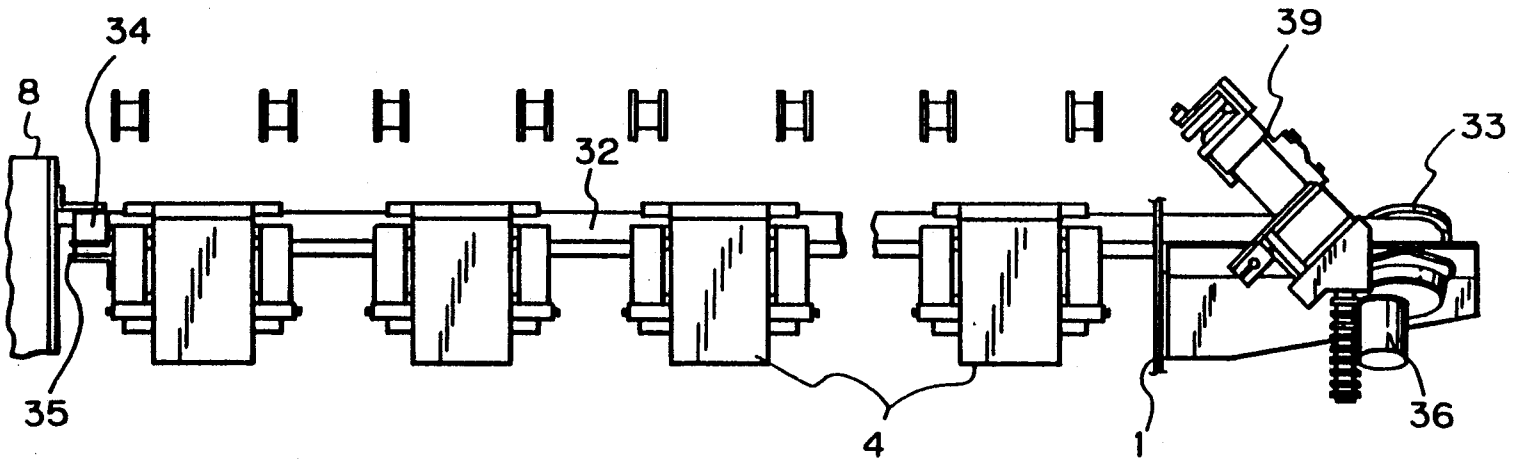
FIG. 6 is a schematic entire view showing an embodiment of the cleaner for drafting mechanisms of the present invention.
Figure 7:
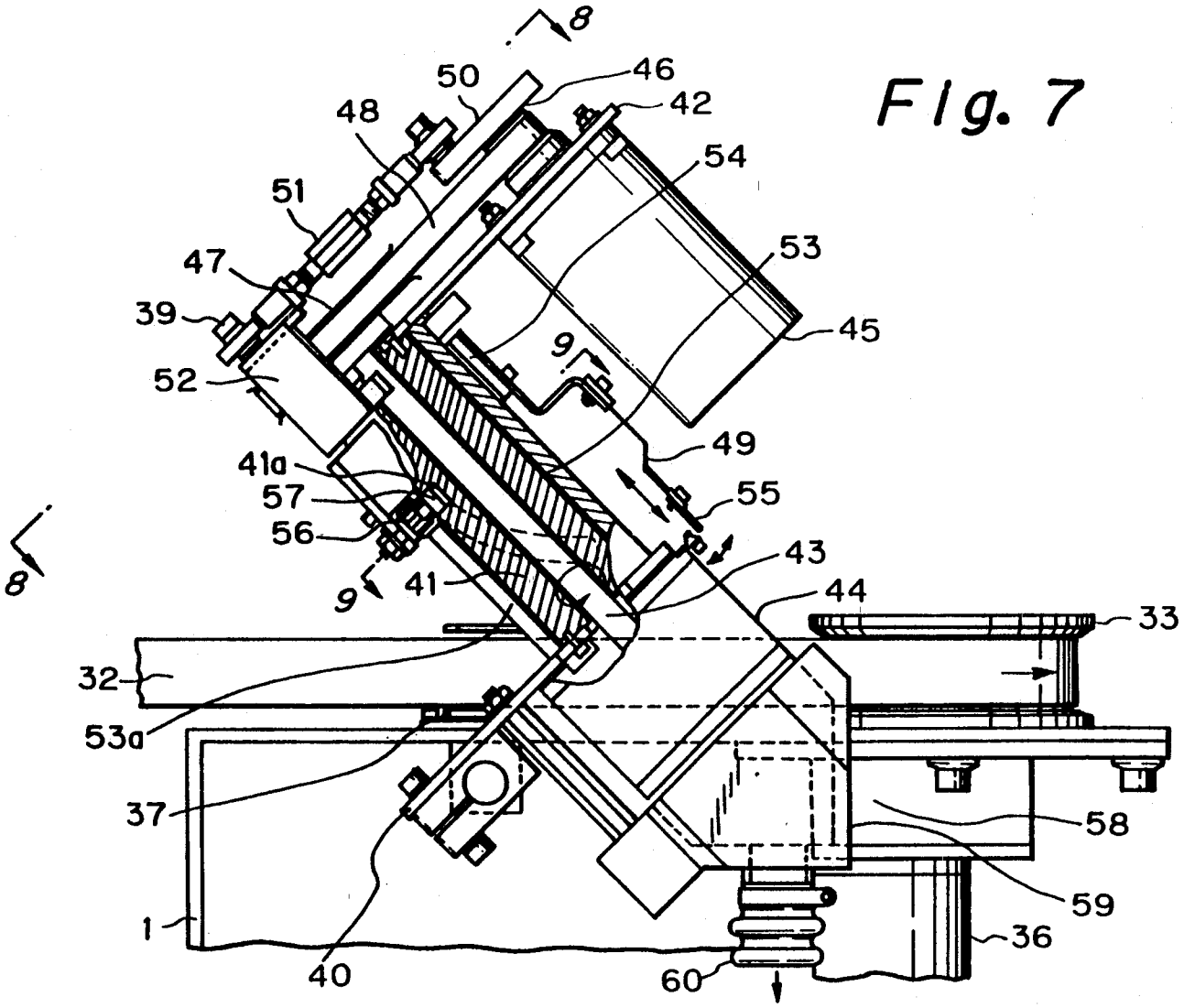
FIG. 7 is a schematic view showing the detail of the collecting mechanism in FIG. 6.
Figure 8:
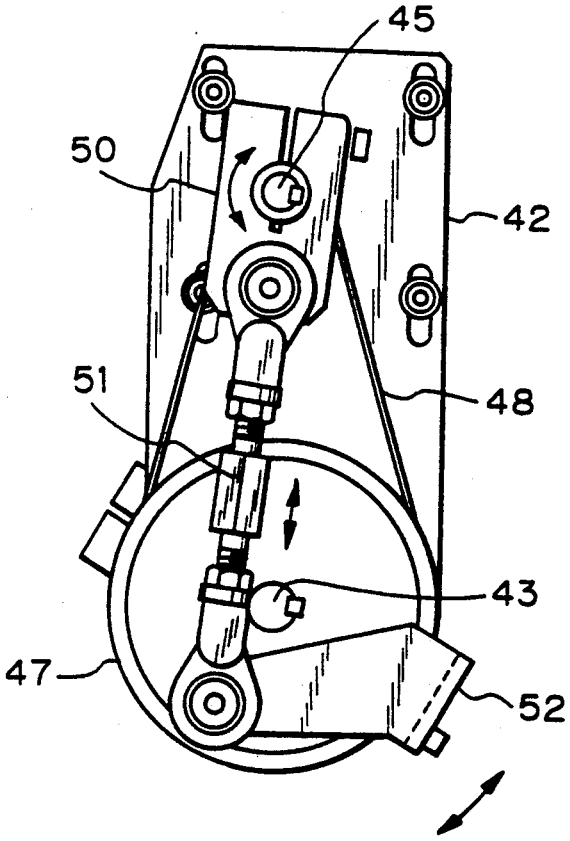
FIG. 8 is a sectional view taken along section line 8—8 viewed from the arrowhead.
Figure 9:
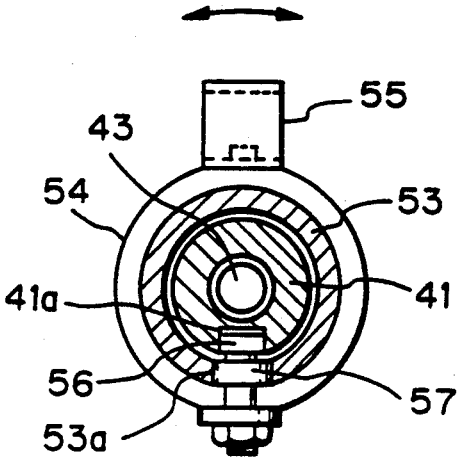
FIG. 9 is a sectional view taken along section line 9—9 viewed from the arrowhead.

FIG. 1 is a front view showing an embodiment of the spinning machine of the present invention, FIG. 2 is a sectional view taken along section line 2—2 viewed from the arrowhead in FIG. 1, FIG. 3 is a schematic enlarged view showing a detail of a drafting mechanism in FIG. 1, FIG. 4 is a plan view of FIG. 3, FIG. 5 is a sectional view taken along section line 5—5 viewed from the arrowhead in FIG. 3, FIG. 6 is a schematic view showing an embodiment of the cleaner for the drafting mechanism of the present invention, FIG. 7 is a schematic view showing a detail of a collecting mechanism in FIG. 6, FIG. 8 is a sectional view taken along section line 8—8 viewed from the arrowhead in FIG. 7, and FIG. 9 is a sectional view taken along section line 9—9 in FIG. 7. In the drawings, reference numeral 1 denotes a gear end equipped with a drive mechanism for rotating rollers or other devices, 2 denotes an outer end provided with a control unit, a lint, suction arrangement (not shown) and the like, 3 denotes a machine frame having frames arranged at predetermined intervals and connected through beams and square bars, 4 denotes drafting mechanisms attached to the beams of the machine frame 3, which is composed of a roller stand section 5 and a top arm section 6 for drafting fiber bundles to a predetermined magnification.

The drafting mechanism 4 is shown in detail in FIGS. 3 and 5, wherein the roller stand section 5 is constituted by a roller stand 7, front bottom roller 8, a second bottom roller 9, and a back bottom roller 10, and the rollers 8, 9, and 10 are rotatably driven by a drive device (not shown) disposed in the gear end 1.

The above-mentioned top arm section 6 includes a top frame 12 rotatably mounted to the roller stand 7 through a support rod 11, a front top roller 13, a second top roller 14, a back top roller 15 carried by a retainer housed in the top arm frame 12, and a hook 16 rotatably mounted on the top arm frame 12 by a pin 17. The engagement of the hook 16 with a pin 18 provided on the roller stand 7 causes the top rollers 13, 14, and 15 to abut against the bottom rollers 8, 9, and 10 under a predetermined surface pressure, through a spring incorporated in the retainer.

The back top roller 15 is provided with a drive periphery 15*a* as shown in FIGS. 3 and 5, and upstream of the back rollers 10 and 15, a trumpet 19 for transporting fiber bundles to a predetermined position is attached to the support rod 11 of the roller stand 7.

Reference numeral 20 designates a clearer mechanism rotatably mounted on the top arm frame 12, and 21 designates a clearer frame rotatably mounted on the top arm frame 12 by means of a support pin 22, on which a drive roller 23 and a driven roller 24 are rotatably mounted. The drive roller 23 has a rotational force transmitting periphery 23*a* and a belt tensioning periphery 23*b*, and the rotational force transmitting periphery 23*a* is rotated by contact with the periphery 15*a* of the back top roller 15. Reference numeral 25 stands for a tenser arm rotatably mounted on the distal end of the clearer frame 21 having a tenser roller rotatably mounted on the end thereof. Reference numeral 27 is a cleaning belt passing through the driving roller 23, the driven roller 24, a tenser roller 26, and running in contact with the peripheries of the second top roller 14 and back top roller 15. The cleaning belt 27 has an outer periphery raised in the direction opposite to the running direction.

The cleaning belt 27 also is in contact with the peripheries of the second top roller 14, and the back top roller 15, and has a slower running speed than the surface speed of the back roller 15, and thus the fiber dust and lint adhering to the periphery of the second top roller 14 and the back top roller 15 are caught by the raised part of the cleaning belt 27 and adhered thereto.

The above-mentioned tenser arm 25 is always caused to rotate in the clockwise direction by a torsion coil spring 28, which tensions the cleaning belt 27 while imparting a predetermined surface pressure to the second top roller 14 and the back top roller 15.

Reference numeral 29 denotes a pin protruding from the top arm frame 12, which prevents a suspension of the clearer frame 21 when the second top roller 14, the back top roller 15 and the like are removed from the top arm frame 12. Reference numeral 30 denotes a belt running guide, and 31 designates a belt supporting guide attached to the roller stand 7.

Reference numeral 32 represents a transporting belt passing through the drive pulley 33 disposed in the gear end 1 and the driven pulleys 34 and 35 attached to the outer end 2, the outer periphery of which has a part raised against the running direction. The drive pulley 33 is rotated by an electric motor 36, and the driven pulleys 34 and 35 are shifted in the longitudinal direction of the transporting belt 32 by a tensioning mechanism (not shown), to thereby tension the transporting belt 32. Reference numeral 37 is a nip roller disposed in the gear end 1, and brings the transporting belt 32 into a contact with the periphery of the driving pulley 33 under a predetermined surface pressure.

The above-mentioned cleaning belt 27 is brought into contact with the transporting belt 32 by a plate spring 38 attached to the clearer frame 21.

Reference numeral 39 signifies a collecting mechanism disposed in the proximity of the drive pulley 33 and in contact with the outer periphery of the transporting belt 32. The collecting mechanism 39 is shown in detail in FIGS. 7 through 9, in which reference numeral 40 denotes a bracket attached to the machine frame 3 integrally provided with a cylindrical support member 41 and a support plate 42. On the periphery of the cylindrical support member 41 is formed a spiral cam groove 41*a*. Reference numeral 43 signifies a shaft member rotatably mounted on the cylindrical support member 41 through a bearing, and having one end attached to a scratch-off roller 44 and the other end attached to a driven pulley 47. Reference numeral 45 represents an electric motor mounted at the support plate 42, the output shaft of which is attached to a drive pulley 46. The scratch-off roller 44 is arranged so that the periphery thereof is brought into contact with the outer periphery of the transporting belt 32 when the axis thereof is tilted at an angle of about 45° with respect to the running direction of the transporting belt 32 and on the outer periphery thereof has a raised part tilted at an angle of 45° against the rotational direction. Reference numeral 48 is a belt passing through the drive pulley 46 and the driven pulley 47, which causes the scratch-off roller 44 to rotate at a predetermined speed. Reference numeral 49 denotes a wiper mechanism disposed in the proximity of the scratch-off roller 44. Reference numeral 50 is a eccentric plate mounted on the output shaft of the electric motor 45 in conjunction with the drive pulley 46, and provided with a connecting rod 51 having a connecting member 52. Reference numeral 53 is a cylindrical rotational member rotatably mounted on the cylindrical support member 41 through a bearing, and on which the connecting member 52 is integrally mounted. The cylindrical portion of the cylindrical rotational member 53 is fitted with a cam groove 53*a* extending in the longitudinal direction of the axis thereof. Reference numeral 54 denotes a movable member mounted on the cylindrical rotational member and shiftable in the longitudinal direction of the axis through the bearing, and having a scratch-off member mounted integrally therewith. The scratch-off member must be formed from a stiff member to be thus able to shift under a condition where it is movable in contact with the periphery of the scratch-off roller 44 under a predetermined surface pressure. Reference numeral 56 represents a first cam follower attached to the movable member 54, which engages the cam groove 53*a* of the cylindrical rotational member 53. Reference numeral 57 denotes a second cam follower attached to an end of the first cam follower 56, which is engaged with the cam groove 41*a* of the cylindrical support member 41.

Thus, when the reciprocation of the connecting rod 51 caused by the rotation of the eccentric plate 50 by the electric motor 45 causes the cylindrical rotational member 53 as well as the connecting member 52 to reciprocate in the circumferential direction along the periphery of the cylindrical support member 41, the movable member 54 reciprocates along the cam groove 53*a* of the cylindrical rotational member 53 due to the engagement of the first cam follower 56 with the cam groove 53*a* of the cylindrical rotational member 53, and due to the engagement of the second cam follower 57 with the spiral cam groove 41*a* of the cylindrical support member 41. Accordingly, when the output shaft of the electric motor 36 is rotated by one turn, the scratch-off member 55 is shifted from one end toward the other end in the longitudinal direction along the periphery of the scratch-off roller 44, and is rotated in the circumferential direction by a predetermined amount. When the scratch-off member 55 arrives at the other end position, it is reversed to return to the initial position.

The above-mentioned collecting mechanism may be provided at the middle portion in the longitudinal direction of the machine frame 3.

Reference numeral 58 is a suction mechanism provided in the proximity of the end of the scratch-off roller 44, which comprises a diffuser 59 mounted to the bracket such that the suction inlet opens facing the end surface of the scratch-off roller 44, and a suction tube 60 having one end connected to the diffuser 59 and the other end connected to the lint suction device (not shown) provided within the outer end 2, and the like.

When the transporting belt 32 runs in contact with the cleaning belt 27, the fiber dust and dust and lint adhering to the cleaning belt 27 is scratched off and adhered the transporting belt 32. Subsequently, when the fiber dust and dust and lint is caught by the scratch-off roller 44, and adhered to the periphery of the roller 44, the scratch-off member 55 of the wiper mechanism moves in the longitudinal direction of the axis and circumferential direction of the scratch-off roller 44, to scratch off the fiber dust and lint adhering to the periphery of the scratch-off roller 44, which is sucked by the diffuser 59 of the suction mechanism 45 and accumulated in the lint suction apparatus (not shown) provided within the outer end 2, by the suction tube 60.

The above-mentioned wiper mechanism 44 may be reciprocated linearly on the scratch-off roller 44 by using a hydraulic cylinder or the like.

Reference numeral 65 denotes a spinning mechanism having a fiber spreading part and an air jet false-twisting part, which spreads the fiber bundles and imparts a false-twisting, to thus form a fasciated spun yarn. Reference numeral 66 denotes a take-off mechanism including a drive roller and a nip roller, which is attached to the square bar of the machine frame 3, to take-off the fasciated spun yarn spun from the spinning mechanism 65 at a predetermined speed. Reference numeral 67*a* represents a winding-up mechanism composed of a cradle for holding the bobbin, and a traverse drum for traversing yarn strands and for rotating the bobbin, which winds up the fasciated spun yarn delivered from the take-off mechanism 66.

The above-mentioned drafting mechanism 4, spinning mechanism 65, take-off mechanism 66, and the winding-up mechanism 67 constitute a spinning unit, in which several to several tens of spinning units are arranged at predetermined intervals in the longitudinal direction of the machine frame 3.

The operation of removing the fiber dust and lint by the cleaner of the drafting mechanism mentioned above will now be described.

The spinning machine is activated to perform the drafting of the fiber bundles by the drafting mechanism 4, the fiber bundles are supplied into a spinning mechanism 65 to spin a fasciated spun yarn, and the obtained spun yarn is delivered at a predetermined speed by the take-off mechanism 66, to be wound up onto the wind-up mechanism 67. When the back top roller 15 is rotated through the operation, the drive roller 23 of the clearer mechanism 20 is also rotated, which in turn causes the cleaning belt 27 to rotate in contact with the apron belt 14*a* of the second top roller 14 and the periphery of the back top roller 15. Thereafter, the fiber dust and lint is adhered to the apron belt 14*a* or the periphery of the back top roller 15 by the drafting of the fiber bundle, and is immediately scratched off by the raised part of the cleaning belt 27, and adhered thereto.

On the contrary, the transporting belt 32 is running in contact with the cleaning belt 27 under a predetermined surface pressure imposed by a plate spring 38, and therefore, the fiber dust and lint adhering to the cleaning belt 27 is caught by the raised part of the transporting belt 32. At that time, the cleaning belt 27 has a raised part extending in the opposite direction to the running direction of the cleaning belt 27, and the fiber dust and lint leaves the raised part and is adhered to the transporting belt 32. The transporting belt 32 is successively rotated, so that the fiber dust and lint adhering to the cleaning belt 27 of the drafting mechanism 4 is successively scratched off.

Next, when the transporting belt 32 to which the fiber dust and lint is adhered reaches the position of the collecting mechanism 39, the fiber dust and lint is picked up by the raised part of the roller 44 and is adhered to the periphery of the roller 44, since the scratch-off roller 44 in contact with the transporting belt 32 is rotated faster than the running speed of the transporting belt 32. Next, the scratch-off member 55 of the wiper mechanism 49 is shifted in the longitudinal direction of the axis and the circumferential direction of the scratch-off roller 44, to scratch off the fiber dust and lint adhering to the periphery of the scratch-off roller 44 which is sucked by the diffuser 59 of the suction mechanism 58 and accumulated on the lint suction apparatus (not shown) by a suction tube 60.

In the cleaner for the drafting mechanism of the spinning machine according to the present invention, there is provided a fiber dust and lint transporting belt 32 in contact with a cleaning belt 27, for transporting the fiber dust and lint adhering to the belt 27 in the longitudinal direction of the scratch-off machine frame 3, and accordingly, the cleaning operation for the drafting mechanism can be performed regardless of the operational condition of the top arm frame 12 of the drafting mechanism 4. In addition, the cleaning belt 27, transporting belt 32, and the collecting mechanism 39 are always in contact with one another during the operation of the spinning machine, and run at a constant speed, and consequently, the load acting on the top rollers 14 and 15 of the drafting mechanism 4 is constant, which ensures a uniform spun yarn without any drafting unevenness.

Also, the transporting belt 32 has at least one surface with a raised part against the running direction of the belt, whereby the fiber dust and lint adhering to the cleaning belt 27 can be securely scratched off and adhered to the periphery thereof.

The transporting belt 32 is allowed to run at the lower position of the top arm frame 12 of the drafting mechanism 4, and thus the entire drafting mechanism 4 can be cleaned regardless of the operational position of the top arm frame 12 of the drafting frame 4.

Furthermore, on the end portion of the machine frame 3 there is arranged a collecting mechanism 39 for scratching off the fiber dust and lint adhering to the transporting belt 32, for collection, which comprises the pickup roller 44, the wiper mechanism 49 shifting on the roller 44, and a suction mechanism, to thereby ensure a successive cleaning operation of the transporting belt 32 without fail.

In the cleaner for the drafting mechanism of the spinning machine according to the present invention, there is arranged a transporting belt in contact with a cleaning belt, for transporting the fiber dust and lint adhering to the belt in the longitudinal direction of the scratch-off machine frame, and thus a cleaning operation for the drafting mechanisms can be achieved regardless of the operational condition of the top arm frame of the drafting mechanism, and the load acting on the top roller of the drafting roller is uniform, to thereby obtain an even spun yarn without any drafting unevenness.

Moreover, the transporting belt has at least one surface with a raised part against the running direction of the belt, whereby the fiber dust and lint adhering to the cleaning belt can be scratched off and adhered to the periphery thereof. Also, the transporting belt is allowed to run at the lower position of the top arm frame of the drafting mechanism, whereby the operational position of the top arm frame of the drafting mechanism does not affect the cleaning operation of the drafting mechanism. Further, the collecting mechanism for scratching off the fiber dust and lint adhering to the transporting belt is arranged on the machine frame, which is constituted by the scratch-off roller, the wiper mechanism shifting on the roller, and the suction mechanism, to successive perform the cleaning operation of the transporting belt without fail. Furthermore, the spinning machine of the present invention includes an open-end spinning machine, a fasciated spinning machine, and a standard ring spinning machine.

We claim:

1. A cleaner for a spinning machine including a plurality of drafting mechanisms arranged at predetermined intervals in a longitudinal direction of a machine frame, each drafting mechanism having a cleaning belt which contacts at least one drafting roller, said cleaner comprising:

a transporting belt in contact with each of said cleaning belts for scratching off fiber dust and lint adhering to said cleaning belts and for transporting the scratched-off fiber dust and lint in the longitudinal direction of the machine frame.

2. A cleaner according to claim 1, wherein said transporting belt has at least one surface having a raised part against a running direction of said belt.

3. A cleaner according to claim 1, wherein said transporting belt runs at a lower position to a top arm frame of the drafting mechanism.

4. A cleaner according to claim 1, further comprising means for scratching off and collecting the fiber dust and lint adhering to said transporting belt.

5. A cleaner for a drafting mechanism of a spinning machine according to claim 4, wherein said means for scratching off and collecting includes:

a scratch-off roller;

a wiper mechanism shifting on said scratch-off roller; and means for suctioning said fiber dust and lint from said scratch-off roller.

6. A cleaner according to claim 5, wherein said scratch-off roller is arranged to rotate at an angle relative to a running direction of said transporting belt.

7. A cleaner according to claim 6, wherein said angle is 45 degrees.

8. A cleaner for a spinning machine including a plurality of drafting mechanisms arranged along an axis of the spinning machine, comprising:

means, arranged in each one of said drafting mechanisms, for cleaning fiber dust and lint from at least one drafting roller in said one of the drafting mechanisms, said cleaning means including a cleaning belt which contacts said at least one drafting roller; and means, arranged along the axis of the spinning machine, for transporting the fiber dust and lint from each of said cleaning means, said transporting means including a transporting belt which contacts each of said cleaning belts.

9. A cleaner for a spinning machine according to claim 8, wherein said transporting belt contacts a bottom side each of said cleaning belts when a top arm frame of the spinning machine is in a lower position.

10. A cleaner for a spinning machine according to claim 8, further comprising means, arranged at one end of said transporting means, for removing from said transporting belt the fiber dust and lint which is transported by the transporting belt.

11. A cleaner according to claim 10 wherein said removing means includes a scratch-off roller which contacts said transporting belt; and means for wiping fiber dust and lint from said scratch-off roller.

12. A cleaner according to claim 11 wherein said scratch-off roller is arranged to rotate at an angle relative to a running direction of said transporting belt.

13. A cleaner according to claim 12, wherein said angle is 45 degrees.

14. A cleaner for a spinning machine according to claim 10, further comprising means for suctioning the fiber dust and lint which is removed from said transporting belt.

15. A cleaner for a spinning machine including a plurality of drafting mechanisms arranged along an axis of the spinning machine, comprising:

a cleaning belt, arranged in each one of said drafting mechanisms to contact at least one drafting roller in said one of the drafting mechanisms, for cleaning fiber dust and lint from the at least one drafting roller in the one drafting mechanism;

a transporting belt, arranged to contact each of said cleaning belts, for transporting the fiber dust and lint from each of said cleaning belts along the axis of the spinning machine;

a scratch-off roller, which contacts said transporting belt and rotates at an angle relative to a running direction of said transporting belt, for removing the fiber dust and lint from said transporting roller;

means for wiping fiber dust and lint from said scratch-off roller; and means for suctioning the fiber dust and lint which is wiped from said scratch-off roller by said wiping means.

16. A cleaner for a spinning machine according to claim 15, wherein said transporting belt contacts a bottom side each of said cleaning belts when a top arm frame of the spinning machine is in a lower position.

17. A cleaner for a spinning machine according to claim 15, wherein said angle is 45 degrees.

* * * * *